United States Patent [19]

Laby

[11] 3,976,316

[45] Aug. 24, 1976

[54] MAGNETIC DOOR LATCH

[75] Inventor: Jordan M. Laby, Los Angeles, Calif.

[73] Assignee: American Shower Door Co., Inc., Santa Monica, Calif.

[22] Filed: Mar. 10, 1975

[21] Appl. No.: 556,675

[52] U.S. Cl. ..... 292/251.5

[51] Int. Cl.[2] ..... E05C 19/16

[58] Field of Search ..... 292/251.5, 201, 144; 339/128, 126

[56] References Cited

UNITED STATES PATENTS

| | | | |
|---|---|---|---|
| 3,351,368 | 11/1967 | Sweet | 292/251.5 |
| 3,414,309 | 12/1968 | Tresemer | 292/251.5 |
| 3,425,729 | 2/1969 | Bisbing | 292/251.5 |

*Primary Examiner*—Richard E. Moore

*Attorney, Agent, or Firm*—Wm. Jacquet Gribble

[57] ABSTRACT

A magnet has a contact face, a registry edge and restraint apertures in which lodge resilient restraints of a magnet holder. The holder has snap fingers and locators for securing the holder to a door stop of a door frame, preferably in an indented section of the stop. The holder cavity has a rocker ridge contacting the registry edge of the magnet, and restraint fingers. The cavity walls, the restraint fingers and the limiting rocker ridge hold the magnet so its contact face has limited freedom to adjust for surface to surface contact with a catch plate or strike on a swinging door. Preferably the magnet holder is shaped with relief openings between the snap fingers, the locators, the cavity walls and the resilient restraint fingers to be conventionally moldable in one piece.

8 Claims, 6 Drawing Figures

MAGNETIC DOOR LATCH

BACKGROUND OF THE INVENTION

The invention relates to magnetic door latches or catches, as they are known in the trade, and more particularly to such catches wherein a holder secures a magnet to a door frame so the contact face of the magnet is free to adjust to the differing planar attitudes of the door strike, to snap against the strike by rocking on a holder ridge, loosely held by resilient side restraints. While other such devices have been attempted, none has been economically practicable nor foolproof because fabricating and installation costs have offset the mechanical advantages of positive latching in such prior catches.

The present invention affords a sure catch that is easily installed, one in which magnet, doorway frame and magnet restraint with rocker ridge combine such that effective operational advantages are not outweighed by high fabrication and installation cost disadvantages of the catch or latch.

SUMMARY OF THE INVENTION

The invention contemplates a magnetic door catch comprising a doorway frame having a stop with an indented stop section separated along one edge from the stop, a magnet with a contact face and an opposite registry edge, the registry edge being reduced at its ends to pass resilient restraints of a magnet holder which spring into restraint notches of the magnet. The magnet holder has resilient fingers that grip the door stop in the indented section to retain the holder with respect to the doorway frame. The holder further has locators on its side adjacent the resilient fingers that are adapted to seat against the frame and stop. Preferably each locator has two mutually perpendicular locator surfaces. A retainer wall opposite an open end of the magnet holder has a registry ridge adapted to engage the registry edge of the magnet, the magnet being movably held in the cavity of the holder by the side walls thereof, the resilient restraints in the registry notches of the magnet, and contact with the registry ridge. The magnet is thus free to adjust within the holder to present a contact face for surface to surface engagement with a ferrous catch plate fixed at that door portion which closes against the doorway frame stop.

In a preferred embodiment of the invention the magnet holder further includes relief channels bounding each resilient finger and each resilient restraint so that the holder may be molded complete in one piece and in one operation.

These and other advantages of the invention are apparent from the following detailed description and drawing.

BRIEF DESCRIPTION OF THE DRAWING

In the various views like parts are identified by like numerals.

DESCRIPTION OF THE PREFERRED EMBODIMENT

Figure 1:
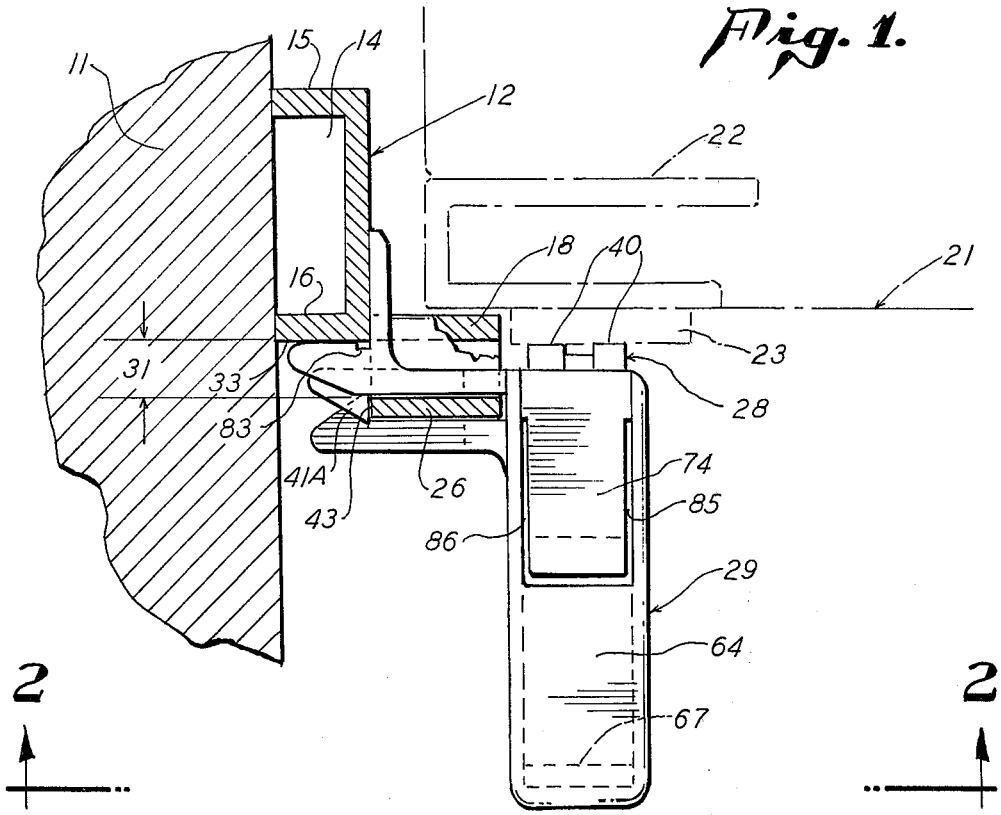
FIG. 1 is a fragmentary plan section of a door catch in accordance with the invention, with a swinging door shown in broken lines.
Figure 2:
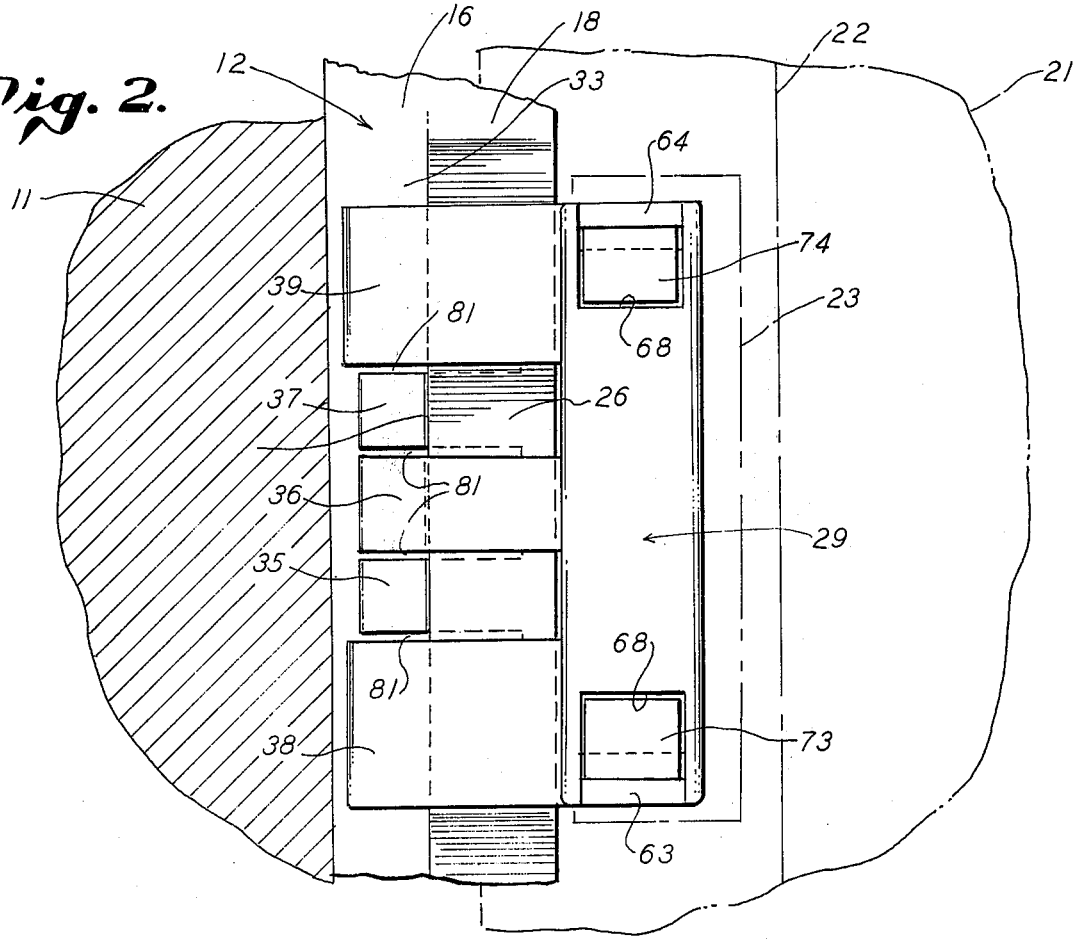
FIG. 2 is a fragmentary elevational view taken along line 2 — 2 of FIG. 1.

In FIGS. 1 and 2 a wall 11 supports a vertical member 12 of a doorway frame. The vertical member has a channel portion 14 with legs 15, 16 abutting wall 11 and an extending stop strip 18. A door 21 shown in phantom lines has a frame member 22 and a latch plate 23. Although the illustrative door is hinged, the invention contemplates effective combination with sliding doors as well.

Figure 4:
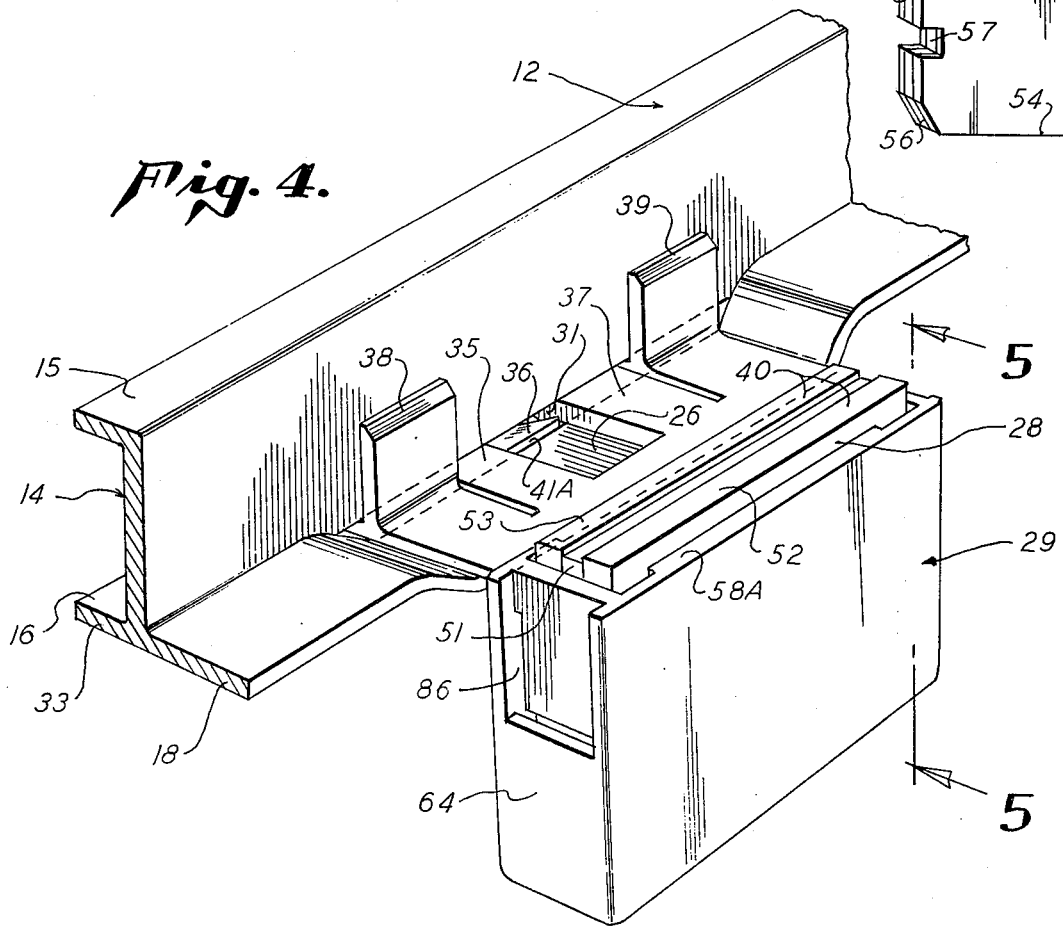
FIG. 4 is a revolved fragmentary perspective view of the embodiment of FIG. 1 with the magnet in place in the holder and the holder attached to the door stop.

A portion of the stop strip is indented or offset from the vertical line of the stop strip in an indent 26, as shown in FIGS. 1 and 4. The vertical extent of the indent is shown in FIGS. 2 and 4, the latter Figure being revolved 90 degrees to show clearly the association between the stop strip and a magnet 28 in a magnet holder 29.

The depth of offset or indentation is greater than the web thickness of stop strip 18 such that an interval or aperture 31 exists between the indent and the outer face 33 of channel leg 16. Magnet holder fingers 35, 36 and 37, and magnet holder locators 38 and 39 engage the channel surfaces adjacent the aperture 31 to secure the holder to the stop strip at the indent 26. The contact face 40 of magnet 28 is thereby precisely and automatically presented for surface engagement with door strike plate 23 as shown in FIG. 1, securing the door frame member 22 at the stop strip 18.

Each holder finger 35, 36, 37 has a catch tab 41 which engages the remote edge 43 of indent 26. Tab 41A on finger 36 is oriented oppositely to the tabs of fingers 35, 37 to grip the indent from both directions. The locators 38, 39 each have contact tabs 45, 46, with the tabs 45 of each locator bearing against the web of channel 12 while the tabs 46 bear against channel leg 16. The tabs of each locator are therefore oriented perpendicularly to each other, fitting against the outside corner of the leg 16 and thus defining a corner fitting against the channel outside the indent surfaces.

The locators preclude motion of the holder toward the doorway wall and the fingers with their catch tabs 41 preclude motion of the holder away from the wall. As can be seen from FIG. 2, the locators restrain vertical motion of the holder because of the wedge fit into the aperture 31 between indent 26 and wall 33 of leg 16. The magnet holder and the restrained magnet 28 are thus maintained in position with respect ot vertical frame member 12 of the doorway.

Figure 6:
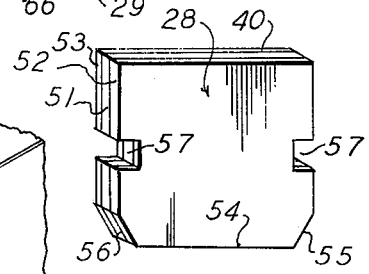
FIG. 6 is a perspective view of the magnet piece.

As can be seen from FIG. 6, magnet 28 is preferably a laminar piece having an inner magnetic layer 51 of a magnetized plastic amalgam, and two outer layers 52, 53 of steel, either zinc coated soft steel or a special "magnetic" stainless steel to resist water. The inner and outer layers are similar in configuration, each having a registry edge 54 with chamfered corners 55, 56 and restraint notches 57 in opposite side edges. The two steel outer layers have faces 40A, 40B that combine to define the contact face of the magnet, the concommitent face of the inner layer being slightly recessed with respect to the steel faces.

Figure 5:
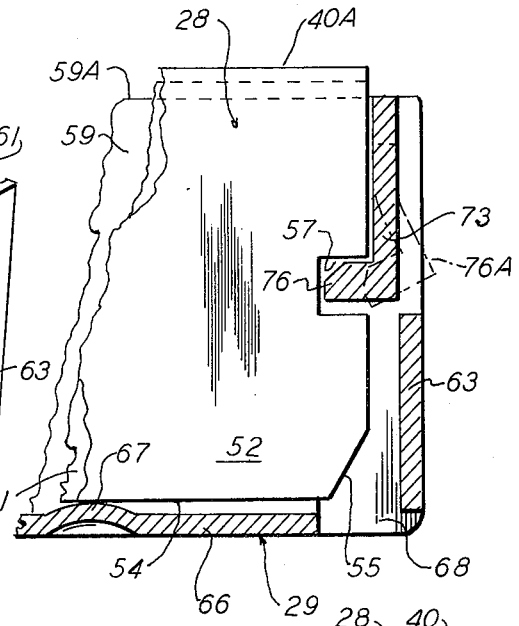
FIG. 5 is a fragmentary sectional view taken along lines 5 — 5 of FIG. 4.

Magnet holder 29 has spaced side walls 58, 59 with corner relief grooves 61 in each wall. End walls 63, 64 extend from a rear wall 66 about midway of the holder depth. The rear wall has a central transverse registry ridge 67 and end openings like opening 68 (FIG. 5). Together the walls define a holder cavity 71 in which the magnet resides. At the end walls resilient restraints 73, 74 bear against the magnet, with restraint tabs 76 of each restraint engaging the magnet notches 57.

The magnet preferably has some freedom within the holder cavity to adjust to the planar orientation of the door strike plate as it swings against stop strip 18. The freedom is determined by contact between the magnet registry edge and the holder registry ridge, restraints 73, 74 at each holder end wall and the fit between restraint tabs 76 and the magnet restraint notches 57. The side walls of the holder are a close slip fit with the magnet and little or no transverse motion of the magnet is allowed. However, since the magnet face 40 projects beyond the adjacent edges 58A, 59A of the holder side walls, the magnet is free within limits to adjust to contact the surface of the door frame latch plate 23. As is evident from FIG. 5, resilient restraints 73, 74 loosely engage the walls of the restraint notches, allowing the face 40 to cant with respect to the side wall edges, rocking on ridge 67 but still held within the holder cavity. Preferably the magnet face aligns in the holder back of the door stop 18 so that the stop takes the initial shock of the closing door frame before the magnet moves to engage the latch plate or strike.

In assembling the inventive door catch the magnet is placed in cavity 71, the chamfered corners 55, 56 of the registry edge encountering the tabs 76 and forcing the resilient restraints outward in the dotted position 76A of FIG. 5 before the magnet traverses the cavity to register its edge 54 against ridge 67. The assembled holder and magnet, with the restraints snapped into thr registry notches, are now aligned vertically at the indent 26 and the fingers and locators thrust through the aperture 31 until the finger catch tabs engage the indent and the locators lodge against channel 12. Thus, with no tools, the catch is assembled with the doorway frame in position to cooperate with the strikeplate to hold the door closed.

Figure 3:
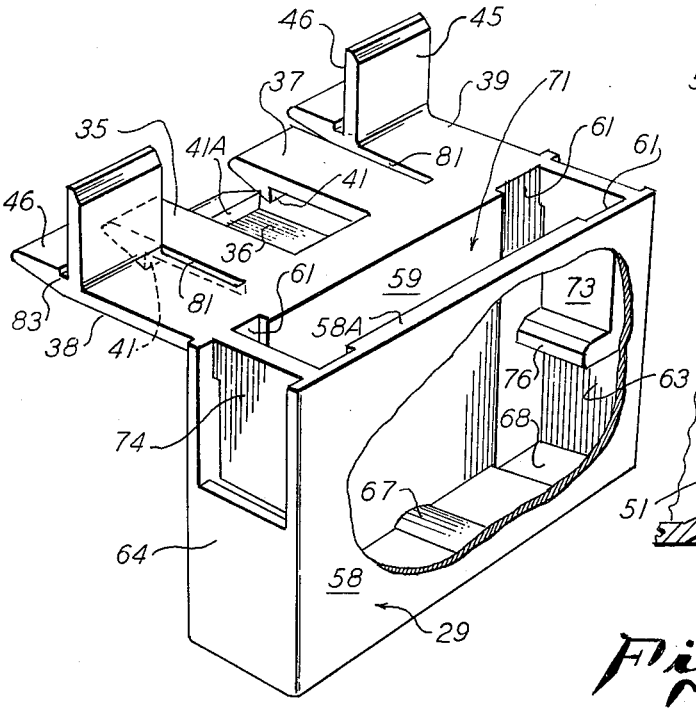
FIG. 3 is a perspective view of the magnet holder of the invention partly broken away.

It can be seen from the drawing, particularly FIG. 3, that the magnet holder is ingeniously made to cooperate with the magnet to fulfill their functions and yet be easily fabricated. Note that each finger and locator is made separate by an elongate groove 81 and that the juncture of the locator surfaces is relieved in notches 83 to aid in withdrawing the molded holder from a mold die. The resilient restraints are parallel to, but offset from, the holder end walls, and rear wall 66 is apertured at 68 such that molding cores may be removed from the restraint tab area after molding. Each restraint is separated from attachment to the side walls by channels 85, 86 for the greater part of its length along the side wall. The relief grooves 61 in the side walls afford edge clearance for in and out motion of the restraints.

It is clear that the elements of the invention are readily made from presently available components by contemporary techniques and the invention is therefore inexpensive to fabricate and install. The doorway frame member may be indented to define indent 26 by a simple punch operation, the magnet components may be punch formed, and the magnet holder molded in a single, split-mold operation.

While a laminar magnet has been used to illustrate the preferred embodiment of the invention, it is to be understood that the invention does not preclude other magnet types. Other modifications within the scope of the invention will occur to those skilled in this art. It is therefore desired that the invention be measured by the appended claims rather than by the illustrative embodiment disclosed herein.

I claim:

1. A catch for a door butting against a stop having an indented section and comprising a magnet, a magnet holder, means securing the magnet holder to the stop at the indented section thereof; a contact face on the magnet, magnet restraint walls and a magnet registry edge defining the periphery of the magnet; said magnet holder having a plurality of walls defining a restraint cavity, and a rear registry ridge which engages the magnet registry edge, and opposed resilient side restraints adapted to engage the magnet restraint walls and to pass the magnet registry edge such that the magnet contact face has freedom to align with the door to adhere magnetically thereto.

2. A catch assembly for a door closing against a stop and comprising a stop indented portion, a magnet, a contact face on the magnet, a registry edge on the magnet and opposed restraint walls on the magnet; a magnet holder, walls defining a restraint cavity in the magnet holder, resilient restraints at opposite ends of the restraint cavity, a registry ridge on a cavity wall which contacts the registry edge of the magnet in the cavity, and means for attaching the holder to the stop indented section.

3. A catch in accordance with claim 2 further comprising an aperture defined between the stop and the stop indented portion adapted to receive the means for attaching the holder.

4. A catch in accordance with claim 3 wherein the means for attaching the magnet holder comprises a plurality of resilient fingers protruding from a side of the holder and passing through said aperture, and a tab on each of said fingers adapted to engage the stop, one of said tabs projecting oppositely from a finger from the tabs of the other fingers.

5. A catch in accordance with claim 3 further comprising at least one locator protruding from a side of the magnet holder, a first contact tab on a locator, a second contact tab on a locator, said first and second locator contact tabs being perpendicular to each other, one of said contact tabs passing through the aperture to contact the said stop.

6. A catch in accordance with claim 5 wherein the means for attaching the magnet holder comprises a plurality of resilient fingers protruding from a side of the holder and passing through said aperture, and a catch tab on all said fingers, one of said catch tabs projecting oppositely from a finger from the tabs of the other fingers.

7. A catch in accordance with claim 2 wherein the end walls defining the magnet cavity are offset from the plane of the resilient restraints, and the cavity wall bearing the registry ridge terminates short of the end walls to define an aperture in said wall in line with each resilient restraint, each restraint being free to spring outwardly with respect to each end wall.

8. A catch in accordance with claim 2 further comprising inwardly extending restraint tabs on each resilient restraint, outwardly opening restraint notches on the magnet, each of said notches exceeding the adjacent restraint tab in the dimension between magnet contact face and magnet registry edge such that the magnet is free to rock on the registry ridge to alter the attitude of the contact face, said magnet further having limited freedom to move into and out of the holder cavity while retained therein by the resilient restraints.

* * * * *